United States Patent [19]

Miller

[11] Patent Number: 4,699,566

[45] Date of Patent: Oct. 13, 1987

[54] BLADE RING FOR A STEAM TURBINE

[75] Inventor: Lewis J. Miller, Winter Springs, Fla.

[73] Assignee: Westinghouse Electric Corp., Pittsburgh, Pa.

[21] Appl. No.: 928,601

[22] Filed: Oct. 22, 1986

Related U.S. Application Data

[63] Continuation of Ser. No. 766,070, Aug. 14, 1985, abandoned, which is a continuation of Ser. No. 592,983, Mar. 23, 1984, abandoned.

[51] Int. Cl.[4] ..... F01D 1/20; F01D 3/04

[52] U.S. Cl. ..... 415/107; 415/190; 415/219 R

[58] Field of Search ..... 415/219 R, 108, 191, 415/131, 132, 112, 140, 107, 218, 189, 190

[56] References Cited

U.S. PATENT DOCUMENTS

| | | | |
|---|---|---|---|
| 1,680,737 | 8/1928 | Hodgkinson | 415/219 UX |
| 3,110,437 | 11/1963 | Oechslin | 415/219 UX |
| 3,206,166 | 9/1965 | Beldecos et al. | 415/112 X |
| 3,233,867 | 2/1966 | Ishibash et al. | 415/131 |
| 3,628,878 | 12/1971 | Trassel et al. | 415/219 R X |
| 3,630,635 | 12/1971 | Fatum | 415/219 R |
| 3,937,589 | 2/1976 | Remberg | 415/219 R X |

FOREIGN PATENT DOCUMENTS

| | | | |
|---|---|---|---|
| 1034924 | 7/1958 | Fed. Rep. of Germany | 415/219 R |
| 2026099 | 1/1980 | United Kingdom | 415/219 R |

*Primary Examiner*—Abraham Hershkovitz
*Assistant Examiner*—Joseph M. Pitko
*Attorney, Agent, or Firm*—F. J. Baehr, Jr.

[57] ABSTRACT

A blade ring for a steam turbine having an outer generally cylindrical casing, an inner generally cylindrical casing disposed within the outer casing and supported by the outer casing and a blade ring to which are affixed a plurality of circular arrays of stationary blades forming stationary blade rows, the blade ring being disposed partially within the inner casing and partially within the outer casing and having a support arm which extends outerwardly to and is supported by the outer casing.

3 Claims, 4 Drawing Figures

BLADE RING FOR A STEAM TURBINE

This application is a continuation of application Ser. No. 06/766,070, filed Aug. 14, 1985, now abandoned, which is a continuation of application Ser. No. 06/592,983, filed Mar. 23, 1984, now abandoned.

BACKGROUND OF THE INVENTION

This invention relates to steam turbines and more particularly to steam turbines with inner casings and blade rings.

Steam turbines are built with an outer casing, an inner casing disposed within the outer casing and supported from the outer casing, and blade rings supported within the inner casing as shown in FIG. 1 and 2 designated as prior art. By moving the support for the blade ring from the inner casing to the outer casing as described hereinafter, a reduction in size of both the outer and inner casings can be obtained.

SUMMARY OF THE INVENTION

In general, a steam turbine, when made in accordance with this invention, comprises an outer cylinderical casing, an inner cylinderical casing disposed within the outer casing and supported from the outer casing, a blade ring disposed partially within the inner casing and partially within the outer casing and having support arms, which extend outwardly to and are supported by the outer casing, whereby the inner and outer cylindrical casings can be made smaller in diameter and the walls of the outer casing can be thinner.

BRIEF DESCRIPTION OF THE DRAWINGS

The objects and advantages of this invention will become more apparent from reading the following detailed description in conjunction with the accompanying drawings, in which.

DESCRIPTION OF A PREFERRED EMBODIMENT

Figure 1:
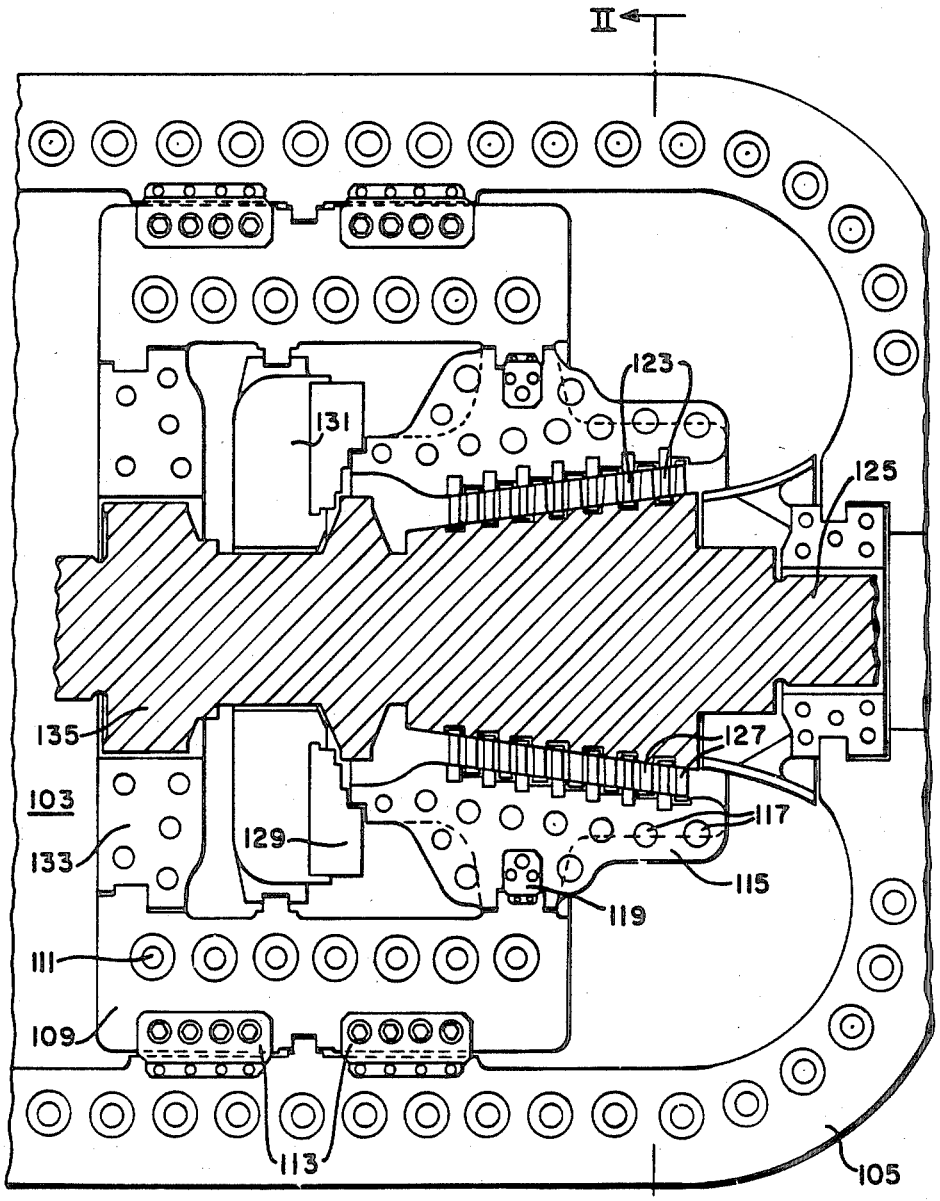
FIG. 1 PRIOR ART
FIG. 1 is a plan view of a prior art steam turbine with upper casings, and various upper rings removed.
Figure 2:
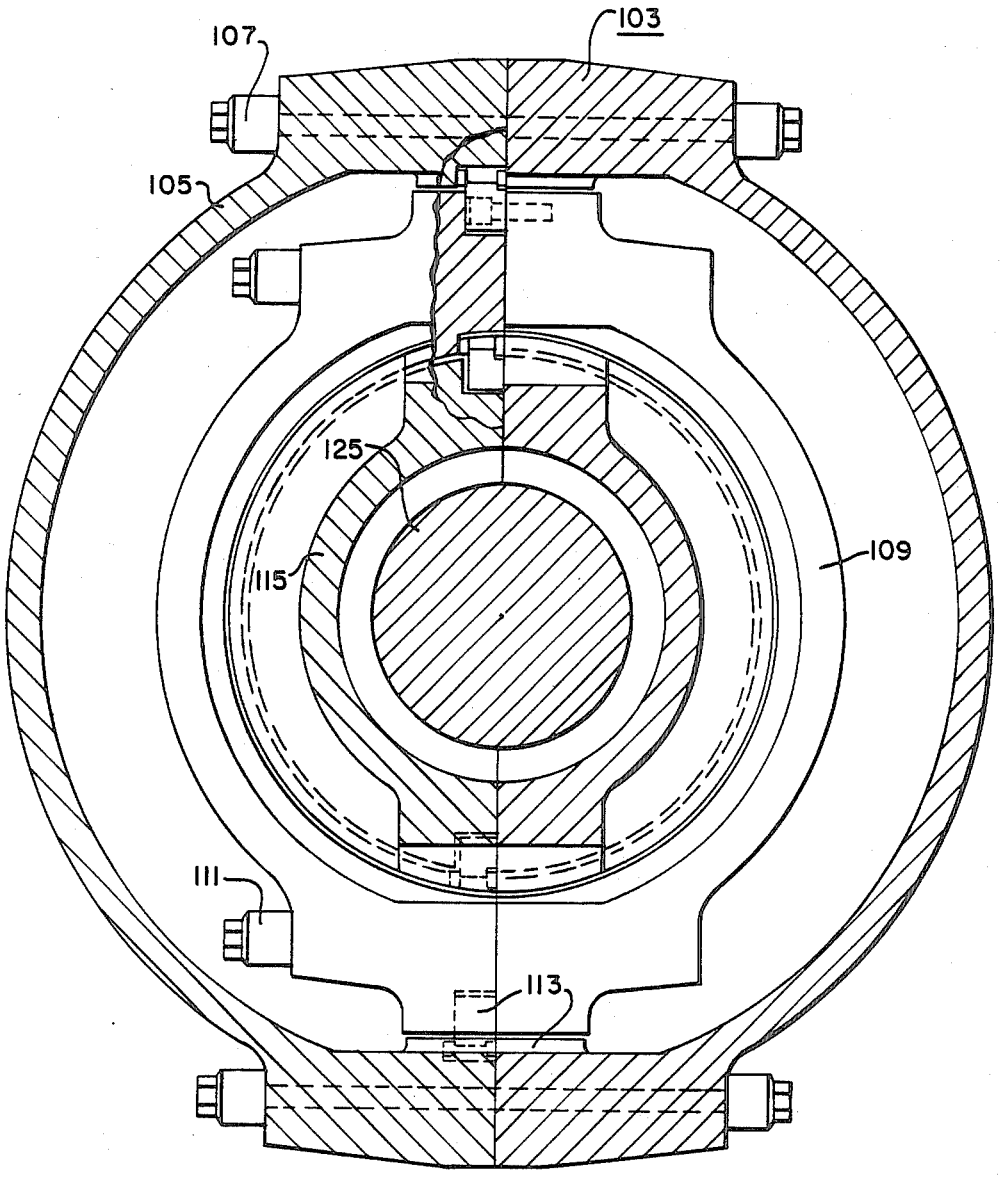
FIG. 2 PRIOR ART
FIG. 2 is a partial sectional view taken on line II—II of FIG. 1.
Figure 3:
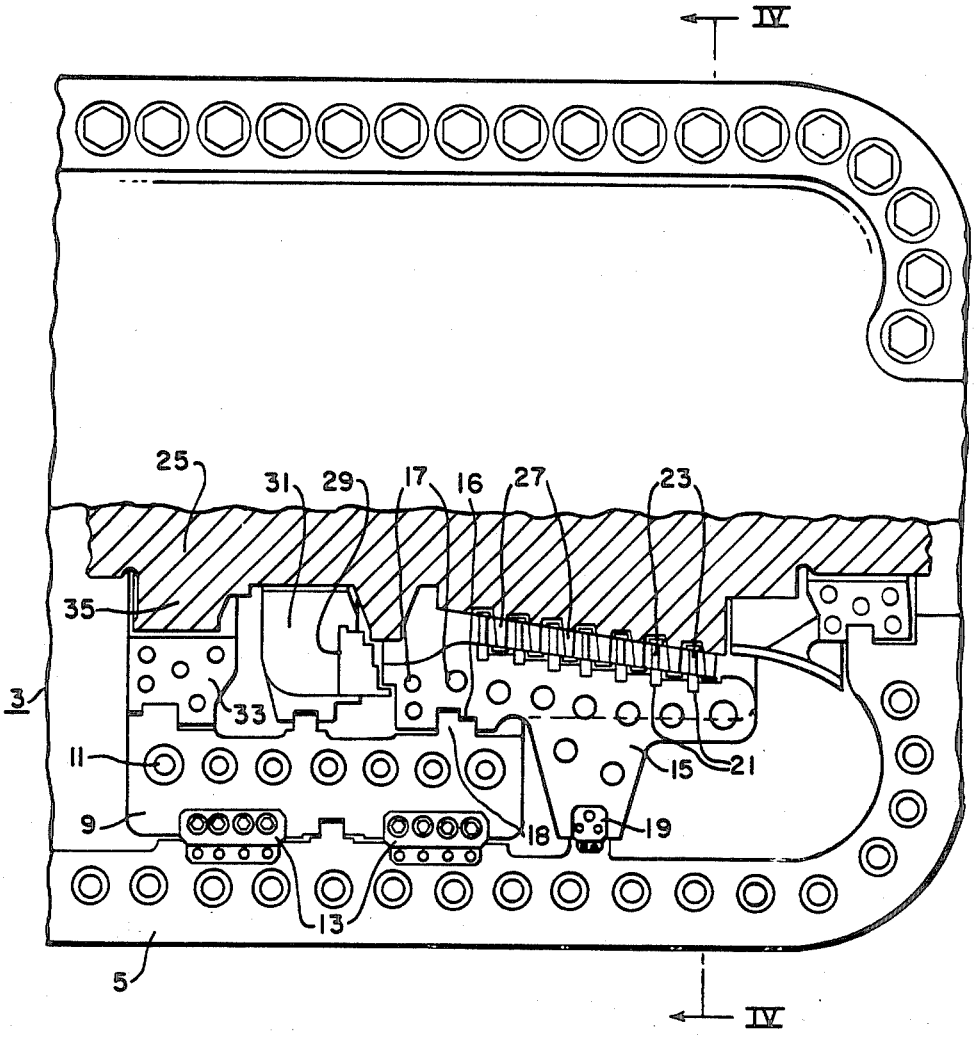
FIG. 3 is a partial plan view of a steam turbine, with upper casings and various upper rings partially removed, made in accordance with this invention.
Figure 4:
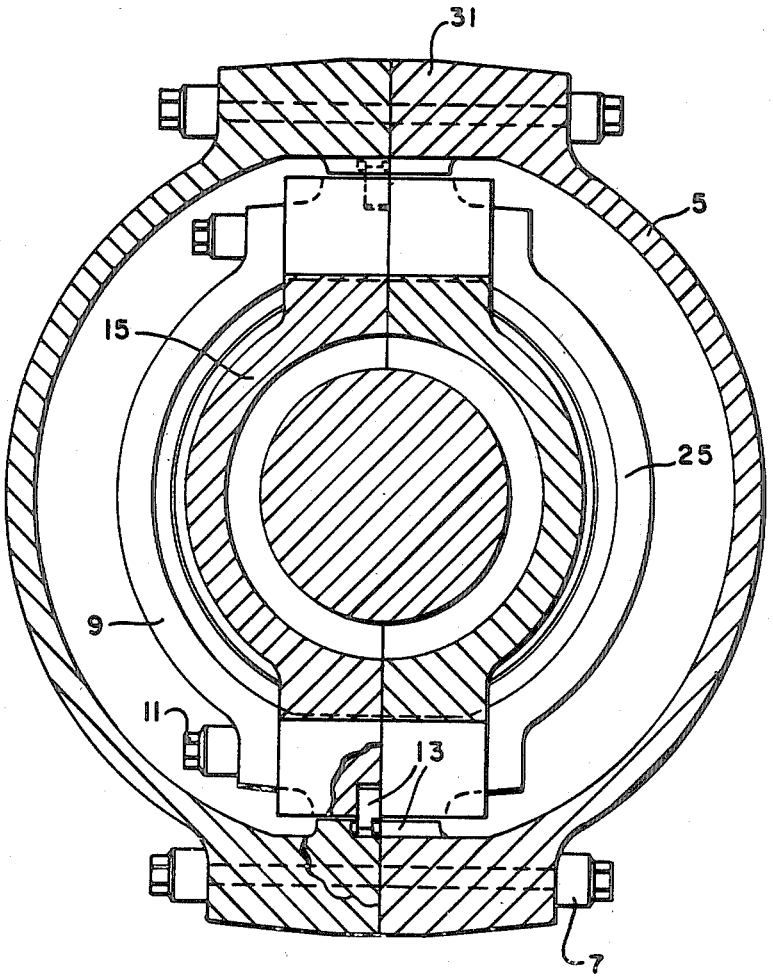
FIG. 4 is a partial sectional view taken on line IV—IV of FIG. 3.

FIGS. 1 and 2 are indicated as prior art and show a steam turbine 103 which is designed for the same operating temperature, pressure and steam throughput as the turbine 3 shown in FIGS. 3 and 4 and made in accordance with this invention. Reference numerals with a 100 prefix in the prior art, FIGS. 1 and 2 indicate parts similar to those indicated by the reference numeral without the prefix in FIGS. 3 and 4.

The turbine 3 comprises a horizontally split cylindrical outer housing or casing 5 held together by bolts 7, a horizontally split cylindrical inner housing or casing 9 held together by bolting 11 and disposed within the outer casing 5 and supported from the outer casing 5 by supports 13, Disposed partially within the inner casing 9 and partially within the outer casing 5 is a longitudinally split blade ring 15 which is also held together by bolting 17. The blade ring 15 is supported on an arm 19 which extends outwardly to and is supported by the outer casing 5. The blade ring 15 has a plurality of circumferential grooves 21 which receive annular arrays of stationary blades forming rows of stationary blades 23. As shown in FIG. 3 the blade ring 15 also has a stepped circumferential groove 16 which registers with a stepped circumferential ring 18 to fix the blade ring axially with respect to the inner casing 9 and turbine 3.

A rotor 25 having a plurality of annular arrays of rotating blades forming rows of rotating blades 27 is disposed within the blade ring 15 and the rows of rotating blades 27 interdigitate with the rows of stationary blades 23.

A nozzle block 29 and nozzle chamber 31 are disposed on one end of the blade ring 15 and within the inner casing 5 for admitting steam to the blade path. Also disposed within the inner casing 5 is a dummy ring 33 which cooperates with an integral balance disc 35 on the rotor to balance the thrust produced by the steam acting on the rotating blades and rotor.

Supporting the blade ring 15 from the outer casing 5 rather than from the inner casing, advantageously increases the resisting momentum acting on the blade ring thus reducing the stresses; support is moved to a lower temperature region lowering the material requirements and raising the allowable stresses; reduces inner and outer casing overall diameter, wall thickness and bolting requirements; and reduces inner casing support size as loading from the blade ring is transmitted directly to the outer casing, thus producing savings in material, manufacturing and handling.

What is claimed is:

1. A steam turbine comprising an outer horizontally split cylindrical heavy wall casing, an inner horizontally split cylindrical heavy wall casing disposed within the outer casing, supported from the outer casing and providing a pressure chamber separate from the outer cylindrical casing, a blade ring completely separate from the inner and outer casings, disposed partially within the inner casing and partially within the outer casing, and said blade ring having support arms which extend outwardly to and are supported by the outer casing and having a stepped circumferential groove which registers with a stepped circumferential ring on the inner casing to axially fix the blade ring within the inner casing and turbine, whereby both the inner and outer casings can be made smaller in diameter and thinner, a series of circular arrays of stationary blades, forming rows of stationary blades so disposed in the blade ring that a majority of the rows of stationary blades are disposed outside the inner casing, a rotor having a series of rows of blades disposed in circular arrays forming rows of rotating blades; the rotor being disposed within the blade ring in such a manner that the rows of rotating blades interdigitate with the rows of stationary blades, and a dummy ring disposed within the inner casing, and a balance disc disposed on the rotor; the dummy ring and balance disc cooperate to balance the thrust load created by the rotating blades and rotor.

2. A steam turbine as set forth in claim 1 wherein the blade ring has a plurality of circumferential grooves for receiving annular arrays of stationary blades which form rows of stationary blades.

3. A steam turbine as set forth in claim 1 and further comprising a nozzle chamber and a nozzle block disposed within the inner casing.

* * * * *